United States Patent [19]

Matsumoto et al.

[11] Patent Number: 5,064,749

[45] Date of Patent: Nov. 12, 1991

[54] DAMPENING WATER COMPOSITION FOR LITHOGRAPHIC PLATE

[75] Inventors: Hiroshi Matsumoto; Kenji Kunichika; Toshio Uchida, all of Shizuoka, Japan

[73] Assignee: Fuji Photo Film Co., Ltd., Minami-Ashigara, Japan

[21] Appl. No.: 559,352

[22] Filed: Jul. 30, 1990

[30] Foreign Application Priority Data

Aug. 2, 1989 [JP] Japan ..... 1-200730

[51] Int. Cl.[5] ..... G03C 5/00

[52] U.S. Cl. ..... 430/331; 430/309; 430/325; 106/2

[58] Field of Search ..... 430/309, 325, 331; 106/2

[56] References Cited

U.S. PATENT DOCUMENTS

| | | | |
|---|---|---|---|
| 4,278,467 | 7/1981 | Fadner | 106/2 |
| 4,560,410 | 12/1985 | Burns et al. | 106/2 |
| 4,641,579 | 2/1987 | Bernstein | 101/451 |
| 4,970,138 | 11/1990 | Lauke et al. | 430/309 |

FOREIGN PATENT DOCUMENTS

| | | |
|---|---|---|
| 0066176 | 5/1982 | European Pat. Off. . |
| 0091601 | 10/1983 | European Pat. Off. . |
| 0336673 | 4/1989 | European Pat. Off. . |

*Primary Examiner*—Hoa Van Le

*Attorney, Agent, or Firm*—Burns, Doane, Swecker & Mathis

[57] ABSTRACT

The present invention relates to a concentrated dampening water for a lithographic printing plate characterized by comprising:

(a) 0.5 to 50% by weight of, as a nonionic surfactant, at least one compound selected from the group consisting of ethylene oxide and/or propylene oxide adduct of 2-ethyl-1,3-hexanediol and ethylene oxide and/or propylene oxide adduct of acetylene alcohol or acetylene glycol, (b) 1 to 30% by weight of 4-hydroxy-4-methyl-2-pentanone and/or a compound of the following formula [I], [III] or [III]:

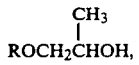

[I]

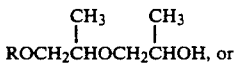

[II]

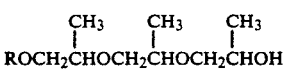

[III]

wherein R represents a methyl group, an ethyl group, a propyl group or a butyl group, and (c) 30 to 75% by weight of water.

According to the present invention, an excellent concentrated dampening water is obtained, which has substantially no toxicity: does not pollute the working environment and causes no fire; necessitates no local exhaust device; and is excellent from the viewpoints of fouling of the metering roll, bleeding, emulsifiability, stability for continuous operation and anti-foaming property. Thus, with the concentrated dampening water of the present invention, the stable printing is possible.

11 Claims, No Drawings

DAMPENING WATER COMPOSITION FOR LITHOGRAPHIC PLATE

BACKGROUND OF THE INVENTION

The present invention relates to a concentrated dampening water useful for offset printing process and also a process for using it.

The lithography is a printing method wherein the essential immiscibility between water and an oil is utilized. The printing plate surface has a region which receives water but repels an oily ink and another region which repels water but receives the oily ink. The former forms a non-image area and the latter forms an image area. A desensitizer has such an effect that when the non-image area is wet with a dampening water containing it, the ink-repellency of the non-image area and ink-receptivity of the image area are increased, because the interfacial chemical difference is enlarged between the image area and the non-image area.

Well-known desensitizers include aqueous solutions containing an alkali metal dichromate, ammonium dichromate, phosphoric acid or its salt such as ammonium phosphate, or a colloidal substance such as acacia gum or carboxymethylcellulose (CMC).

However, the dampening water containing such a desensitizer has a defect that it cannot easily and homogeneously wet the non-printing area of the plate, staining the prints and that the control of the feeding amount of the dampening water to printing plate necessitates a considerably delicate technique.

To overcome this defect, Dahlgren dampening system has been proposed wherein about 20 to 25% aqueous solution of isopropyl alcohol is used as a dampening water. This method has various advantages in the workability and accuracy of the prints such as that the wetting of the non-image area is improved, that the amount of the dampening water is reduced, that the balance between the amounts of the printing ink to be fed and water to be fed can be easily adjusted, that the quantity of the dampening water to be emulsified into the printing ink is reduced, and that the transfer of the printing ink to the blanket is improved.

However, since isopropyl alcohol easily evaporates, a specific apparatus is necessitated for keeping the isopropyl alcohol concentration of the dampening water constant, which elevates the cost. Further, isopropyl alcohol is not preferred from the viewpoint of the working environment, because it has peculiar, bad smell and toxicity.

Another problem is that even when the dampening water containing isopropyl alcohol is used for an ordinary offset printing method in which a dampening roller is used, its effect cannot be obtained, since isopropyl alcohol evaporates on the roller and the plate surface.

Further, the social concern about environmental polluiton is increasing, chromium ion concentration of waste water is severely controlled, and the use of organic solvents such as isopropyl alcohol is going to be regulated from the viewpoint of the hygienic safety. Under these circumstances, the development of a desensitizer free from these organic solvents has been demanded.

To attain the object, various compositions containing a surfactant are described in, for example, Japanese Patent Publication for Opposition Purpose (hereinafter referred to as 'J. P. KOKOKU') Nos. 55-25075, 55-19757 and 58-5797. However, when such a composition is used as a dampening water, a considerably high surfactant concentration of the desensitizer is necessitated in order to obtain a surface tension of 35 to 50 dyne/cm. In the practical lithography, the ink and water vigorously move under the conditions of the ink roll, the printing plate and the dampening water-feeding roll, which rotate at a high speed. Therefore, problems such as that water adheres to the ink film and that the ink is diffused on the water surface, are posed. However, the above-described combination of the surfactants is insufficient for completely solving these problems. Another defect of the dampening water containing such a surfactant is that it easily bubbles during the transportation through pumps or by stirring.

In U.S. Pat. No. 3,877,372, is described a solution containing a mixture of ethylene glycol monobutyl ether with at least one of hexylene glycol and ethylene glycol. In U.S. Pat. No. 4,278,467, is described a dampening water containing at least one of 2-hexyloxyethanol, diethyleneglycol n-hexylether, 2-ethyl-1,3-hexanediol, n-butoxyethylene glycol acetate, n-butoxydiethylene glycol acetate and 3-butoxy-2-propanol. In Japanese Patent Publication for Opposition Purpose (hereinafter referred to as 'J. P. KOKOKU') No. 57-199693(=U.S. Pat. No. 4,560,410), is described a dampening water containing 2-ethyl-1,3-hexanediol and at least one of completely water-soluble propylene glycol, ethylene glycol, dipropylene glycol, diethylene glycol, hexylene glycol, triethylene glycol, tetraethylene glycol, tripropane glycol and 1,5-pentanediol. These dampening water compositions are advantageous from the viewpoints of safety and hygiene, since they are free from isopropyl alcohol. However, they still have problems that when a PS plate having an anodized aluminum support is used, the wetting of the non-image area during the printing is insufficient and, in particular, the non-image area is stained during high-speed printing and the shapes in the halftone dot-image area become abnormal, enlarged and uneven, that is, so-called plugging of half-tone dots image is caused in the halftone dot-image area. Another problem is that the solubility of 2-ethyl-1,3-hexanediol in water is insufficient and this compound is unsuitable for the preparation of a dampening water concentrate of a high concentration or an additive for the dampening water.

SUMMARY OF THE INVENTION

Accordingly, the object of the present invention is to provide a concentrated dampening water for lithography, which can provide high quality printed matters and have excellent properties such as that it is free from toxicity or defects of the conventional dampening waters, that the quantity thereof to be fed during the printing operation can be easily controlled without necessitating the delicate technique of the specialists, that fouling or blinding of the printing plate, particularly of a PS plate having a support made of electrochemically surface-roughened anodized aluminum is inhibited, and that it is usable for a high-speed printing with, for example, off set printing machine.

After intensive investigations made for the purpose of attaining the above-described objects, the inventors have found out that these objects can be easily attained by using a dampening water composition for lithography which will be described below. The present invention has been completed on the basis of this finding.

The present invention relates to a concentrated dampening water for lithography characterized by comprising:

(a) 0.5 to 50% by weight of, as a nonionic surfactant, at least one compound selected from the group consisting of ethylene oxide and/or propylene oxide adduct of 2-ethyl-1,3-hexanediol and ethylene oxide and/or propylene oxide adduct of acetylene alcohol or acetylene glycol, (b) 1 to 30% by weight of 4-hydroxy-4-methyl-2-pentanone and/or a compound of the following formula [I], [II] or [III]:

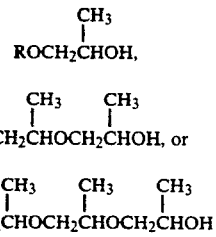

[I]

[II]

[III]

wherein R represents a methyl group, an ethyl group, a propyl group or a butyl group, and (c) 30 to 75% by weight of water.

DETAILED EXPLANATION OF THE INVENTION

In the present invention, the nonionic surfactant is used mainly for controlling the dynamic surface tension in the range of 30 to 50 dyne/cm. The nonionic surfactant is at least one compound selected from the group consisting of ethylene oxide and/or propylene oxide adduct of 2-ethyl-1,3-hexanediol and ethylene oxide and/or propylene oxide adduct of acetylene alcohol or acetylene glycol. As an ethylene oxide and/or propylene oxide adduct of acetylene alcohol or acetylene glycol, preferably is for example, an adduct of 2,4,7,9-tetramethyl-5-decyne-4,7-diol, 2,5-dimethyl-3-hexyne-2,5-diol, 3-methyl-1-butyne-3-ol, 3-methyl-1-pentyne-3-ol or 3,6-dimethyl-4-octyne-3,6-diol.

The molar number of ethylene oxide and/or propylene oxide added is particularly important in the present invention. It is preferably in the range of 1 to 20 mol. When it exceeds 20 mol, the reduction of the dynamic surface tension becomes insufficient and excellent printing properties cannot be easily obtained.

The amount of the nonionic surfactant in the concentrated dampening water of the present invention is 0.5 to 50% by weight, preferably 5 to 40% by weight.

4-Hydroxy-4-methyl-2-pentanone or the following compound is used as a component for suitably regulating the surface tension in combination with the above-described nonionic surfactant:

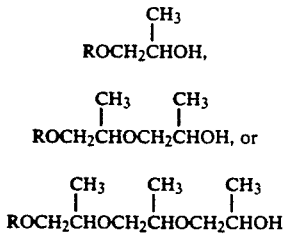

[I]

[II]

[III]

wherein R represents a methyl group, an ethyl group, a propyl group or a butyl group.

This compound is used in an amount of 1 to 30% by weight, preferably 2 to 28% by weight. When the concentrated dampening water is diluted with water in this limited range, the wettability, bleeding of the ink and emulsion stability of the dampening water composition are improved.

Water used in the present invention is not particularly limited. It is, for example, city water, well water or demineralized water. Water is used in an amount of usually 30 to 75% by weight, preferably 35 to 70% by weight.

If necessary, a film-forming, water-soluble polymeric compound can be used in the present invention. This compound makes the non-image area of the lithographic plate hydrophilic. Examples of the preferred polymeric compounds include natural substances such as acacia gum(gum arabic), starch derivatives (e.g. dextrin, dextrin decomposed with amylase, hydroxypropylated dextrin decomposed with amylase, carboxymethylated starch, starch phosphate and octenylsuccinstar ch), alginic acid salts, cellulose derivatives (such as carboxymethyl cellulose, carboxyethyl cellulose, hydroxyethyl cellulose, methyl cellulose, hydroxypropyl cellulose, hydroxypropylmethyl cellulose and glyoxal-modified products of them) and modified products of these natural substances; and synthetic substances such as polyvinyl alcohol and derivatives thereof, polyvinylpyrrolidone, polyacrylamide and copolymers thereof, polyacrylic acid and copolymers thereof, vinyl methyl ether/maleic anhydride copolymer and vinyl acetate/maleic anhydride copolymer. These polymeric compounds can be used either singly or in the form of a mixture of them. The concentration thereof is preferably 0.05 to 10% by weight based on the concentrated dampening water composition.

If necessary, a water-soluble organic acid and/or inorganic acid or a salt thereof can be used in the present invention. Such a compound is effective for adjusting or buffering pH of the dampening water composition and suitably etching or anti-corroding the support of the lithographic plate. Preferred organic acids include, for example, citric acid, ascorbic acid, malic acid, tartaric acid, lactic acid, acetic acid, gluconic acid, hydroxyacetic acid, oxalic acid, malonic acid, levulinic acid, sulfanilic acid, p-toluenesulfonic acid, phytic acid and organic phosphonic acids. The inorganic acids include, for example, phosphoric acid, nitric acid and sulfuric acid. Further, alkali metal salts, alkaline earth metal salts or ammonium salts of these organic acids and/or inorganic acids are also preferred. The organic acids, inorganic acids and/or salts of them can be used either singly or in the form of a mixture of two or more of them.

The amount of the acid or salt thereof to be added to the concentrated dampening water is preferably in the range of 0.5 to 20% by weight. The pH of the dampening water composition after diluted with water is preferably in an acidic region of 3 to 7. However, it may also be in an alkaline region of 7 to 11, which is realized by adding an alkali metal hydroxide, alkali metal phosphate, alkali metal carbonate or silicate.

Other surfactants, in addition to the above-described components, can be added to the concentrated dampening water composition of the present invention. They include, for example, anionic surfactants such as fatty acid salts, abietic acid salts, hydroxyalkanesulfonic acid salts, alkanesulfonic acid salts, dialkylsulfosuccinic acid salts, straight-chain alkylbenzenesulfonic acid salts, branched alkylbenzenesulfonic acid salts, alkylnaphthalenesulfonic acid salts, alkylphenoxypolyoxyethylenepropylsulfonic acid salts, polyoxyethylene alkylsulfophenyl ether salts, sodium salt of N-methyl-N-oleyltaurine, disodium salts of N-alkylsulfosuccinmonoamides, petroleum sulfone complex salts, sulfonated castor oil, sulfonated beef tallow oil, sulfuric ester salts of fatty acid alkyl esters, alkylsulfuric ester salts, polyoxyethylene alkyl ether sulfate salts, fatty acid monoglyceride sulfuric ester salts, polyoxyethylene alkylphenyl ether sulfuric ester salts, polyoxyethylene styrylphenyl ether sulfuric ester salts, alkyl phosphoric ester salts, polyoxyethylene alkyl ether phosphoric ester salts, polyoxyethylene alkyl phenyl ether phosphoric ester salts, partially saponified styrene/maleic anhydride copolymer, partially saponified olefin/maleic anhydride copolymer and naphthalenesulfonic acid salt/formalin condensates. Among them, the dialkylsulfosuccinic acid salts, alkylsulfuric ester salts and alkylnaphthalenesulfonic acid salts are particularly preferably used.

The nonionic surfactants include polyoxyethylene alkyl ethers, polyoxyethylene alkylphenyl ethers, polyoxyethylene polystyrylphenyl ether, polyoxyethylene polyoxypropylene alkyl ethers, partial esters of glycerol/fatty acids, partial esters of sorbitan/fatty acids, partial esters of pentaerythritol/fatty acids, propylene glycol monofatty acid esters, partial esters of sucrose/fatty acids, partial esters of polyoxyethylene sorbitan/fatty acids, partial esters of polyoxyethylene sorbitol/fatty acids, polyethylene glycol/fatty acid esters, partial esters of polyglycerol/fatty acids, polyoxyethylenated castor oils, partial esters of polyoxyethylene glycerol/fatty acids, fatty acid diethanolamides, N,N-bis-2-hydroxyalkylamines, polyoxyethylenealkylamines, triethanolamine/fatty acid esters and trialkylamine oxides. Among them, the polyoxyethylene alkylphenyl ethers and polyoxyethylene/polyoxypropylene block polymers are preferably used.

The cationic surfactants include alkylamine salts, quaternary ammonium salts, polyoxyethylene alkylamine salts and polyethylenepolyamine derivatives.

From the viewpoint of the bubbling, the amount of the surfactant is not more than 10% by weight, preferably 0.01 to 3% by weight.

The present concentrated dampening water may comprise a wetting agent. Such a wetting agent is preferably ethylene glycol, propylene glycol, triethylene glycol, butylene glycol, hexylene glycol, diethylene glycol, dipropylene glycol, glycerol, trimethylolpropane or diglycerol. The wetting agent can be used either singly or in combination of two or more of them. Usually the wetting agent is used preferably in an amount of 1 to 25% by weight.

The concentrated dampening water of the present invention may contain a chelating compound. Usually the concentrated dampening water is diluted with city water, well water or the like before use. Although calcium ion, etc. contained in the city water or well water used as a dilute exhibit a bad effect on the printing because they stain the prints. However, such a defect can be overcome by adding the chelating compound. Preferred chelating compounds include ethylenediaminetetraacetic c acid and its potassium or sodium salt; diethylenetriaminepentaacetic acid and its potassium or sodium salt; triethylenetetraminehexaacetic acid and its potassium or sodium salt; hydroxyethylethylenediaminetriacetic acid and its potassium or sodium salt, nitrilotriacetic acid and its sodium salt; 1-hydroxyethane-1,1-diphosphonic acid and its potassium or sodium salt; and organic phosphonic acid salts or phosphonoalkanetricarboxylic acids such as aminotri(methylenephosphonic acid) and its potassium or sodium salt. The sodium salts or potassium salts of the above-described chelating agents can be replaced with organic amine salts of them. The chelating agent is selected so that it is stable in the dampening water composition and it does not impair the printability. The chelating agent is added in an amount of 0.001 to 10% by weight, preferably 0.01 to 5% by weight, to the concentrated dampening water.

Various colorants, anti-foaming agents, anti-septics, etc. can be added to the concentrated dampening water of the present invention. For example, edible dyes are preferably usable as a colorant. For example, yellow dyes include CI Nos. 19140 and 15985, red dyes include CI Nos. 16185, 45430, 16255, 45380 and 45100, purple dyes include CI No. 42640, blue dyes include CI Nos. 42090 and 73015, and green dyes include CI No. 42095. As an anti-foaming agent, silicon anti-foaming agents are preferred. They can be either emulsion-dispersible or soluble in the concentrated dampening water. They are used preferably in an amount of 0.001 to 1% by weight.

The antiseptic includes phenol or its derivatives, formalin, imidazole derivatives, sodium dehydroacetate, 4-isothiazoline-3-on derivatives, benzotriazole derivatives, amidines, guanidine derivatives, quanternary ammonium salts, pyridine, quinoline and guanidine derivatives, diazine, triazole derivatives, oxazole and oxazine derivatives. The preferred amount of the antiseptic is such that it exhibits a stable effect on bacteria, fungi and yeasts. Although the amount varies depending on the kind of the bacteria, fungi and yeasts, it is preferably 0.01 to 4% by weight based on the dampening water concentrate. It is preferred to use combination of two or more antiseptics in order to exhibit their effects on various fungi and bacteria.

The above components are dissolved in water, preferably in pure water (desalted water) to form a dampening water concentrate. The amount of water of the dampening water concentrate is 30 to 75% by weight.

5 to 30 ml of the concentrated dampening water of the present invention is added to 1 l of water to form a dampening water composition to be applied to the printing machine.

The lithographic plates for which the concentrated dampening water of the present invention can be used include presensitized light-sensitive lithographic plates (PS plates), deep-etch plate, multilayer metal plates such as bimetal and trimetal layer plates, direct masters, electrophotographic lithographic plates, etc.

The presensitized light-sensitive lithographic plates (PS plates) used in the present invention comprise a support having a hydrophilic surface and light-sensitive layers containing a light-sensitive composition placed thereon. The light-sensitive composition includes those containing a diazo compound, those containing an azide compound as described in British Patent Nos. 1,235,281 and 1,495,861, those containing a photo-crosslinking photopolymer as described in U.S. Pat. No. 3,860,426, those containing a photo-polymerizable photopolymer as described in U.S. Pat. Nos. 4,072,528 and 4,072,527, photoconductive compositions as described in J. P. KOKAI Nos. 56-19063 and 56-29250, and silver halide emulsion compositions as described in J. P. KOKAI Nos. 52-62501 and 56-111852.

Among these light-sensitive compositions, those containing a diazo compound are preferably used, because they have excellent properties such as storability of the light-sensitive layers, developing properties such as developing latitude, image-forming properties such as quality of the image, and printing properties such as ink-receptivity, sensitivity and abrasion resistance, and the developer to be applied thereto substantially does not pollute the environment.

The light-sensitive compositions containing the diazo compound can be classified into negative-working type and positive-working type.

The negative-working light-sensitive compositions containing the diazo compound are those containing a light-sensitive diazo compound and preferably a polymeric compound. As the light-sensitive diazo compounds, those known in the art can be used. Preferred examples of them include salts of organic solvent-soluble diazo resins such as a salt of a condensate of p-diazodiphenylamine and formaldehyde or acetaldehyde with hexafluorophosphate or with 2-hydroxy-4-methoxybenzophenone-5-sulfonate.

Preferred polymeric compounds include, for example, acrylic acid or methacrylic acid copolymers, crotonic acid copolymers, itaconic acid copolymers, maleic acid copolymers, cellulose derivatives having a carboxyl group at a side chain thereof, polyvinyl alcohol derivatives having a carboxyl group at a side chain thereof, hydroxyalkyl acrylate or methacrylate copolymers having a carboxyl group at a side chain thereof, and unsaturated polyester resins having a carboxyl group.

The diazo compounds contained in the positive-working light-sensitive composition are known. Typical examples of them include o-quinone diazides such as preferably o-napthoquinone diazide compounds. Among the o-naphthoquinone diazide compounds, particularly preferred are o-naphthoquinone diazide sulfonic acid esters or o-naphthoquinone diazide carboxylic acid esters of various hydroxyl compounds; and o-naphthoquinone diazide sulfonic acid amides or o-naphthoquinone diazide carboxylic acid amides of aromatic amino compounds. Preferred hydroxyl compounds include condensate resins comprising a phenol and a carbonyl group-containing compound. The phenols include phenol per se, cresol, resorcinol and pyrogallol. The carbonyl group-containing compounds include formaldehyde, benzaldehyde and acetone. Preferred hydroxyl compounds include phenol/formaldehyde resin, cresol/formaldehyde resin, pyrogallol/acetone resin and resorcinol/benzaldehyde resin.

Typical examples of the o-quinone diazide compounds include esters of benzoquinone-(1,2)-diazidosulfonic acid or naphthoquinone-(1,2)-diazidosulfonic acid with phenol/formaldehyde resin or cresol/formaldehyde resin; the ester of naphthoquinone-(1,2)-diazido-(2)-5-sulfonic acid with resorcinol/benzaldehyde resin as described in J. P. KOKAI No. 56-1044; the ester of naphthoquinone-(1,2)-diazidosulfonic acid with pyrogallol/acetone resin as described in U.S. Pat. No. 3,635,709; and the ester of naphthoquinone-(1,2)-diazido-(2)-5-sulfonic acid with resorcinol/pyrogallol-/acetone copolycondensate as described in J. P. KOKAI No. 55-76346. Other o-quinone diazide compounds usable herein include the esterification reaction product of a polyester having a terminal hydroxyl group with o-naphthoquinone diazidosulfonyl chloride as described in J. P. KOKAI No. 50-117503; the esterification reaction product of p-hydroxystyrene homopolymer or copolymer thereof with another copolymerizable monomer with o-naphthoquinone diazidosulfonyl chloride as described in J. P. KOKAI No. 50-113305; the ester of bisphenol/formaldehyde resin with o-quinone diazidosulfonic acid as described in J. P. KOKAI No. 54-29922; the condensate of o-quinonediazidosulfonyl chloride with a copolymer of an alkyl acrylate, acryloyloxyalkyl carbonate and hydroxyalkyl acrylate as described in U.S. Pat. No. 3,859,099; the reaction product of o-quinonediazidesulfonic acid with a copolymerization product of styrene and a phenol derivative as described in J. P. KOKOKU No. 49-17481; the amide of o-naphthoquinone diazidel sulfonic acid or o-naphthoquinone diazidecarboxylic acid with a copolymer of p-aminostyrene and a copolymerizable monomer as described in U.S. Pat. No. 3,759,711; and the ester of a polyhydroxybenzophenone with o-naphthoquinone diazide sulfonyl chloride.

Although these o-quinone diazide compounds can be used singly, it is preferably mixed with an alkali-soluble resin to form a mixture to be used as a light-sensitive layer. Preferred alkali-soluble resins include novolak-type phenol resins such as phenol-formaldehyde resin, cresol-formaldehyde resin, and the phenol/cresol-formaldehyde copolycondensate resin described in J. P. KOKAI No. 55-57841. It is more preferred to use the above-described phenolic resin in combination with the condensate of a phenol or cresol substituted with an alkyl group having 3 to 8 carbon atoms with formaldehyde such as t-butylphenol/formaldehy de resin as described in J. P. KOKAI NO. 50-125806.

If necessary, an alkali-soluble resin other than the above-described alkali-soluble novolac-type phenolic resin can be incorporated therein. Examples of them include styrene/acrylic acid copolymer, methyl methacrylate/methacrylic acid copolymer, alkali-soluble polyurethane resin, and the alkali-soluble vinyl resins and alkali-soluble polybutyral resins described in J. P. KOKOKU No. 52-28401.

The amount of the o-quinonediazide compound is preferably 5 to 80% weight, particularly preferably 10 to 50% by weight, based on the total solid components in the light-sensitive composition. The amount of the alkali-soluble resin is preferably 30 to 90% by weight, particularly preferably 50 to 85% by weight, based on the total solid components in the light-sensitive composition.

One or more light-sensitive composition layers can be formed. If necessary, additives such as a dye, plasticizer and printing-out component can be added thereto.

The amount of the light-sensitive composition to be applied to the support is preferably 0.1 to 7 $g/m^2$, more preferably 0.5 to 4 $g/m^2$.

If necessary, a primer layer can be formed between the support and the light-sensitive composition layer. The primer layer comprises, for example, a metal salt and a hydrophilic cellulose as described in J. P. KOKOKU No. 57-16349, polyvinyl phosphonic acid as described in J. P. KOKAI No. 46-35685, $\beta$-alanine as described in J. P. KOKAI No. 60-149491 or triethanolamine hydrochloride as described in J. P. KOKAI No. 60-232998.

The supports usable for the light-sensitive lithographic plate to be used in the present invention are those made of aluminum (including an aluminum alloy), paper or a plastic (such as polyethylene, polypropylene, polyethylene terephthalate, cellulose diacetate, cellulose triacetate, cellulose propionate, polyvinyl acetal or polycarbonate) and also composite supports composed of a metal such as zinc or copper laminated with aluminum or having an aluminum layer formed theron by vapor deposition.

The aluminum surface is preferably roughened in order to increase water retention and to improve the adhesion to the light-sensitive layer.

The roughening methods include generally known brush abrasion method, ball abrasion method, electrolytic etching method, chemical etching method, liquid honing method and sandblasting method as well as a combination of them. Among them, the brush abrasion method, electrolytaic etching method, chemical etching method and liquid honing method are preferred. A roughening method wherein the electrolytic etching step is included is particularly preferred. As an electrolytic bath to be used in the electrolytic etching, an aqueous solution of an acid, alkali or a salt thereof or an aqueous solution containing an organic solvent is used. Among them, an electrolytic solution containing hydrochloric acid, nitric acid or a salt thereof is preferred. The surface-roughened aluminum plate is desmutted, if necessary, with an aqueous acid or alkali solution. The aluminum plate thus formed is desirably subjected to anodic oxidation, and particularly preferably it is treated with a bath containing sulfuric acid or phosphoric acid. Further, if necessary, the plate can be subjected to a surface treatment such as sealing treatment or immersion in an aqueous solution of potassium fluorozirconate.

The PS plate thus prepared is exposed to a light source rich in active ray such as a carbon arc lamp, a mercury lamp, a metal halide lamp or a tungsten lamp through a transparent original and then developed by a wet developing method.

The developer to be used in the above-described developing step is an alkaline solution containing water as a main solvent. It may contain an organic solvent, anionic surfactant, inorganic salt, etc. depending on the alkali used.

It is also effective to incorporate an anti-foaming agent, a wetting agent, etc. into the developer, if necessary.

After the image-forming exposure, the PS plate is developed with the developer by various known methods. They include, for example, a method wherein the PS plate after the image-forming exposure is immersed in the developer, a method wherein the developer is sprayed onto the light-sensitive layer of the PS plate through many nozzles, a method wherein the light-sensitive layer of the PS plate is wiped with a sponge impregnated with the developer, and a method wherein the developer is applied to the surface of the light-sensitive layer of the PS plate with a roller. After the application of the developer to the light-sensitive layer of the PS plate, its surface can be lightly rubbed with a brush or the like.

After the above-described development process, the PS plate is further subjected to a combination of the steps of washing with water, rinsing, desensitization, etc. to complete the development thereof.

The concentrated dampening water of the present invention is usually diluted with water before use. With the dampening water of the present invention, prints free from scumming, scumming by oxidizing and roller stripping or reduction of ink density due to an excess emulsification phenomenon of ink and water can be produced. The prints have an excellent shape of the dots. The efficiency of the printing and the productivity can be improved. When the dampening water composition is used particularly for a printing machine of a continuous water supply type such as Dahlgren dampening system, excellent prints can be obtained without using isopropyl alcohol. However, even when isopropyl alcohol is used in an amount of as small as, for example, 1 to 15%, the quality of the prints is not impaired.

The concentrated dampening water is diluted with at least 90% by weight, preferably 95% by weight, of water to adjust the solid content of the dampening water to 0.01 to 3% by weight in the lithography. The most preferred composition of the dampening water is such that after the dilution with water, it has a dynamic surface tension of 30 to 50 dyne/cm and a viscosity of 1.1 to 5.0 cp.

The dampening water of the present invention has an excellent property of wetting the lithographic plate to prevent the fouling or blinding of the non-image area. Another merit is that the loss of the paper is remarkably reduce deconomically and advantageously.

The following Examples will further illustrate the present invention. Unless otherwise stated, percentages are given by weight.

EXAMPLE 1

A concentrated dampening water having the following composition was prepared:

| | |
|---|---|
| Pure water | 65.7 parts by weight |
| Magnesium nitrate | 1 |
| Sodium hexametaphosphate | 0.5 |
| Phosphoric acid (85%) | 0.5 |
| Ethylene oxide (1 to 5 mol) adduct of 2-ethyl-1,3-hexanediol | 20 |
| 4-Hydroxy-4-methyl-2-pentanone | 12 |
| Anti-septic (trade name: PROXEL CRL mfd. by ICI Japan Ltd.) | |

The concentrated dampening water was prepared by adding magnesium nitrate and sodium hexametaphosphate to pure water under stirring to obtain a homogeneous solution. Other components were successively added thereto and they were stirred until a homogeneous solution was obtained. The concentrated dampening water thus prepared was diluted with water to a concentration of 1:40 to obtain the dampening water to be used.

On the other hand, FPS (anodized multi-grain type positive-working PS plate manufactured by Fuji Photo Film Co., Ltd.) as a lithographic plate was subjected to image-forming exposure and then developed and gumed up with a PS automatic developing machine 900 D, a positive developer A having a composition as shown below and a positive finisher gum having a composition as shown below. The plate was then attached to HARRIS AURELIA 125 (offset printing machine of Dahlgren dampening system manufactured by Marubeni (HARRIS Printing Machine Co., Ltd.). Then, the dampening water prepared as described above and an ink (Apex G Red S manufactured by Dainippon Ink & Chemicals, Inc.) were set and the following properties of the dampening water were evaluated:

| | |
|---|---|
| Positive-working developer A: | |
| Sodium silicate ($SiO_2/Na_2O$ molar ratio: 1:1) | 2 g |
| Sodium ethylenediaminetetraacetate $4H_2O$ | 0.1 g |
| Water | 97.9 g |
| Finisher gum composition: | |
| Aqueous phase (A) | |
| Acacia gum | 4 g |
| Dextrin | 16 g |
| Phosphoric acid (85%) | 0.2 g |
| Water | 75 g |
| Oil phase (B) | |
| Sodium dialkylsulfosuccinate | 1 g |
| Rosin ester | 0.5 g |
| Dioctyl phthalate | 3 g |

The liquid [B] was added to the liquid [A] to obtain an emulsion having a pH of around 3.5.

a. Fouling of a metering roll: Degree of fouling of a metering roll for feeding dampening solution with the ink was examined.

| | |
|---|---|
| Good: | A |
| Comparatively bad: | B |
| Bad: | C |

b. Bleeding: After producing 5,000 prints and 10,000 prints with an ink (Apex G Red S manufactured by Dainippon Ink & Chemicals, Inc.), the printing machine was stopped and the degree of bleeding of the ink from the image area to the non-image area was examined.

| | |
|---|---|
| Substantially no bleeding: | A |
| Slight bleeding: | B |
| Serious bleeding: | C |

c. Emulsifiability: After producing 10,000 prints, the degree of emulsification of the ink on the ink-kneading roll was determined:

| | |
|---|---|
| Good: | A |
| Comparatively bad: | B |
| Bad: | C |

d. Stability for continuous operation: 10,000 prints were produced by using fresh water as a dampening water to determine the quantity of the dampening water spent until fouling was caused (minimum water feeding). Various dampening waters each in this quantity were used for the printing and the number of the prints produced until the prints began to be fouled was examined:

| | |
|---|---|
| More than 10,000 prints: | A |
| 10,000 to 3,000 prints: | B |
| Less than 3,000 prints: | C |

From the test results obtained by the use of the dampening water of Example 1, it was found that the dampening water was excellent in respect of (a) fouling of the metering roll, (b) bleeding, (c) emulsifiability and (d) stability for continuous operation, and that excellent prints were obtained.

Further, the dampening water was circulated continuously for 10 hr without replenishing it and changes of the concentration of the components were examined to reveal that they were scarcely changed and had an excellent stability.

COMPARATIVE EXAMPLE 1

An etching soluiton having the following composition for the engraving printing process [according to Insatsu Gakkai (Printing Society)] was prepared as a dampening water:

| | |
|---|---|
| Magnesium nitrate | 113 g |
| Phosphoric acid (85%) | 37 ml |
| Water | ad 3785 ml |

50 ml of the above etching solution was diluted with 3785 ml of water. 30 ml of an acacia gum solution (14° Be') was added thereto and further isopropyl alcohol was added so that the concentration of the alcohol was 15%, to obtain a comparative solution.

The properties of the dampening water were examined in the same manner as that of Example 1 to reveal that the ink receptivity was slightly impaired in a five line portion of the image area of the lithographic plate. No fouling of the metering portion was observed but the stability for the continuous operation (d) was insufficient.

The dampening water was circulated continuously at 15° C. for 10 hr without replenishing it and changes of the concentration of the components were examined. The results reveal that the quantity of isopropyl alcohol was reduced by about 20% based on the initial quantity thereof.

EXAMPLES 2 to 5

Concentrated dampening waters of the following compositions (Examples 2 to 5) were prepared in the same manner as that of Example 1 and the properties of the dampening water were evaluated (see Table 1).

| Example 2 | |
|---|---|
| Pure water | 57.5 parts by weight |
| Glyoxal-modified cellulose derivative (methoxyl group: 19 to 24%/hydropropoxyl group: 4 to 12%) | 0.5 |
| KOH | 0.5 |
| Nickel nitrate | 2.0 |
| Ammonium primary citrate | 2.0 |
| Phosphoric acid (85%) | 2.0 |
| Ethylene oxide (3 to 7 mol) adduct of 2-ethyl-1,3-hexanediol | 25 |
| Dipropylene glycol monomethyl ether | 10 |
| Antiseptic | 0.3 |
| Anti-foaming agent | 0.1 |

| Example 3 | |
|---|---|
| Pure water | 61.1 parts by weight |
| Carboxymethyl cellulose (CMC) (trade name Cellogen 7A) | 0.1 |
| Glyoxal-modified cellulose derivative (methoxyl group: 19 to 24%/hydropropoxyl group: 4 to 12%) | 0.3 |
| NaOH | 0.4 |
| Magnesium nitrate | 1.5 |
| 5 Na diethylenetriaminepenta-(methylenephosphonate) | 0.2 |
| Phosphoric acid | 0.6 |
| Ethylene oxide (3 to 10 mol) | 20 |

-continued

| Example 3 | |
|---|---|
| adduct of 2,4,7,9-tetramethyl-5-decyne-4,7-diol | |
| Methoxypropanol | 15 |
| Ethylene oxide/propylene oxide block copolymer (trade name: Pluronic P-85 mfd. by Asahi Denka Co., Ltd.) | 0.5 |
| Antiseptic (trade name: DELTOP mfd. by Takeda Chemical Industries, Ltd.) | 0.2 |
| Andi-foaming agent (emulsified silicon anti-foaming agent) | 0.1 |

| Example 4 | |
|---|---|
| Pure water | 68.6 parts by weight |
| Glyoxal-modified cellulose derivative (methoxyl group: 28 to 30%/hydroxypropyl group: 7 to 12%) | 0.3 |
| Monoethanolamine | 0.2 |
| Phosphoric acid | 0.3 |
| Zinc nitrate | 0.2 |
| Ethylene oxide (4 to 10 mol)/propylene oxide (1 to 2 mol) adduct of 2-ethyl-1,3-hexanediol | 15 |
| Ethylene oxide (3 to 10 mol) adduct of 2,4,7,9-tetramethyl-5-decyne-4,7-diol | 5 |
| Dipropylene glycol monomethyl ether | 10 |
| Antiseptic (trade name: BIOHOPE mfd. by KI Kasei Co., Ltd.) | 0.2 |
| Anti-foaming agent (trade name: KS-607 mfd. by The Shin-Etsu Chemical Co., Ltd.) | 0.2 |

| Example 5 | |
|---|---|
| Pure water | 67.8 parts by weight |
| Vinyl methyl ether/maleic anhydride copolymer (trade name: GANTREZ S-95) | 1.0 |
| Magnesium nitrate | 1.0 |
| Phosphoric acid (85%) | 0.2 |
| Sodium hexamethaphosphate | 0.2 |
| Ethylene oxide (3 to 10 mol) adduct of 2-ethyl-1,3-hexanediol | 18 |
| 4-Hydroxy-4-methyl-2-pentane | 10 |
| Methoxypropanol | 2 |
| Antiseptic (trade name: BIOHOPE | 0.2 |

-continued

| Example 5 | |
|---|---|
| mfd. by KI Kasei Co., Ltd.) | |

TABLE 1

| | Properties of Dampening Water | | | | |
|---|---|---|---|---|---|
| | Example | | | | Comparative |
| | 2 | 3 | 4 | 5 | Example |
| (a) Fouling of metering roll | A or B | A | A | A | A |
| (b) Bleeding | A | A | A | A | A |
| (c) Emulsifiability | A or B | A | A | A or B | A |
| (d) Stability for continuous operation | A | A | A | A | B |
| Change of the composition during running | Scarcely changed | Scarcely changed | Scarcely changed | Scarcely changed | Seriously changed |

A: good B: bad

The concentrated dampening waters prepared in Examples 2 to 5 were tested as follows: FNS (anodized multi-grain type negative-working PS plate manufactured by Fuji Photo Film Co., Ltd.) as a lithographic plate was exposed and then developed and gumed up with a PS automatic developing machine 800 H, a negative developer having a composition which will be shown below and a negative-working finisher gum having a composition which will also be shown below. After printing with HARRIS AURELIA 125 (offset printing machine manufactured by Marubeni HARRIS Printing Machine Co., Ltd.), the dampening waters were evaluated. The results of the evaluation suggest that they had excellent properties as shown in Table 1.

| Composition of negative-working developer: | | |
|---|---|---|
| Monoethanolamine | | 10 g |
| Sodium isopropylnaphthalenesulfonate | | 20 g |
| Benzyl alcohol | | 30 g |
| Benzoic acid | | 3 g |
| Water | ad | 1000 ml |
| Negative-working finisher gum composition: | | |
| Aqueous solution C | | |
| Acacia gum | | 4 g |
| Dextrin | | 16 g |
| Phosphoric acid (85%) | | 0.05 g |
| Water | | 75 g |
| Solution D | | |
| Sodium dialkylsuccinate | | 1 g |
| dibutyl phthalate | | 2 g |
| Polyoxyethylene nonylphenyl ether (HLB = 8) | | 1 g |
| Sorbitan monooleate | | 1 g |

The solution D was added to the aqueous solution C to prepare an emulsion.

The concentrated dampening water for a lithographic plate of the present invention has substantially no toxicity. It does not pollute the working environment and causes no fire. It necessitates no local exhaust device. In addition, it is excellent from the viewpoints of fouling of the metering roll, bleeding, emulsifiability, stability for continuous operation and anti-foaming property. Thus, with the concentrated dampening water of the present invention, the stable printing is possible.

What is claimed is:

1. A concentrated dampening water for a lithographic printing plate characterized by comprising:

(a) 0.5 to 50% by weight of, as a nonionic surfactant, at least one compound selected from the group consisting of ethylene oxide and/or propylene oxide adduct of 2-ethyl-1,3-hexanediol and ethylene oxide and/or propylene oxide adduct of acetylene alcohol or acetylene glycol, (b) 1 to 30% by weight of 4-hydroxy-4-methyl-2-pentanone and/or a compound of the following formula [I], [III] or [III]:

$$ROCH_2\overset{\overset{\displaystyle CH_3}{|}}{C}HOH, \qquad [I]$$

$$ROCH_2\overset{\overset{\displaystyle CH_3}{|}}{C}HOCH_2\overset{\overset{\displaystyle CH_3}{|}}{C}HOH, \text{ or} \qquad [II]$$

$$ROCH_2\overset{\overset{\displaystyle CH_3}{|}}{C}HOCH_2\overset{\overset{\displaystyle CH_3}{|}}{C}HOCH_2\overset{\overset{\displaystyle CH_3}{|}}{C}HOH \qquad [III]$$

wherein R represents a methyl group, an ethyl group, a propyl group or a butyl group, and (c) 30 to 75% by weight of water.

2. The concentrated dampening water of claim 1 wherein the molar number of ethylene oxide and/or propylene oxide of said nonionic surfactant is 1 to 20.

3. The concentrated dampening water of claim 1 wherein said acetylene alcohol or acetylene glycol is selected from the gorup consisting of 2,4,7,9-tetramethyl-5-decyne-4,7-diol, 2,5-dimethyl-3-hexyne-2,5-diol, 3-methyl-1-butyne-3-ol, 3-methyl-1-pentyne-3-ol and 3,6-dimethyl-4-octyne-3,6-diol.

4. The concentrated dampening water of claim 1 wherein the amount of said nonionic surfactant is 5 to 40% by weight.

5. The concentrated dampening water of claim 1 wherein said 4-hydroxy-4-methyl-2-pentanone and/or said compound of the formula [I], [II] or [III] is used in an amount of 2 to 28% by weight.

6. The concentrated dampening water of claim 1 wherein water is used in an amount of 35 to 70% by weight.

7. The concentrated dampening water of claim 1 which further contains 0.05 to 10% by weight of a film-forming water-soluble polymeric compound.

8. The concentrated dampening water of claim 7 wherein said polymeric polymer is selected from the group consisting of acacia gum; dextrin, dextrin decomposed with amylase, hydroxypropylated dextrin decomposed with amylase, carboxymethylated starch, starch phosphate and octenylsuccin-starch; alginic acid salts; carboxymethyl cellulose, carboxyethyl cellulose, hydroxyethyl cellulose, methyl cellulose, hydroxypropyl cellulose, hydroxypropylmethyl cellulose and glyoxal-modified products of them; and modified products thereof; and polyvinyl alcohol and derivatives thereof, polyvinylpyrrolidone, polyacrylamide and copolymers thereof, polyacrylic acid and copolymers thereof, vinyl methyl ether/maleic anhydride copolymer and vinyl acetate/maleic anhydride copolymer.

9. the concentrated dampening water of claim 1 which further contains 0.5 to 20% by weight of a water-soluble organic acid and/or inorganic acid or a salt thereof.

10. The concentrated dampening water of claim 9 wherein said organic acid is selected from the group consisting of citric acid, ascorbic acid, malic acid, tartaric acid, lactic acid, acetic acid, gluconic acid, hydroxyacetic acid, oxalic acid, malonic acid, levulinic acid, sulfanilic acid, p-toluenesulfonic acid, phytic acid and organic phosphonic acids; said inorganic acid is selected from the group consisting of phosphoric acid, nitric acid and sulfuric acid; and said salt is selected from the group consisting of alkali metal salts, alkaline earth metal salts or ammonium salts.

11. A dampening water composition characterized by having a solid content of 0.01 to 3% by weight and which is prepared by diluting the concentrated dampening water of claim 1.

* * * * *